US008789399B2

(12) United States Patent
Braeutigam et al.

(10) Patent No.: US 8,789,399 B2
(45) Date of Patent: Jul. 29, 2014

(54) METHOD FOR LEVELING PARTS IN A ROLLER LEVELING MACHINE

(75) Inventors: Horst Braeutigam, Eggenstein-Leopoldshafen (DE); Gerald Khim, Waghaeusel (DE)

(73) Assignee: ARKU Maschinenbau GmbH, Baden-Baden (DE)

( * ) Notice: Subject to any disclaimer, the term of this patent is extended or adjusted under 35 U.S.C. 154(b) by 338 days.

(21) Appl. No.: 13/003,186

(22) PCT Filed: Jul. 10, 2009

(86) PCT No.: PCT/EP2009/058849

§ 371 (c)(1), (2), (4) Date: Jan. 7, 2011

(87) PCT Pub. No.: WO2010/004037

PCT Pub. Date: Jan. 14, 2010

(65) Prior Publication Data

US 2011/0138868 A1 Jun. 16, 2011

(30) Foreign Application Priority Data

Jul. 10, 2008 (EP) ..... 08012481

(51) Int. Cl.
*B21D 1/02* (2006.01)
*B21D 3/02* (2006.01)

(52) U.S. Cl.
USPC ..... 72/160; 72/164

(58) Field of Classification Search
CPC ..... B21B 37/22; B21B 37/16; B21B 37/165; B21D 3/00; B21D 3/02; B21D 3/05; B21D 1/00; B21D 1/02
USPC ..... 72/160, 164, 8.9, 9.2, 11.6, 11.8, 12.7, 72/18.6, 18.8, 162, 165
See application file for complete search history.

(56) References Cited

U.S. PATENT DOCUMENTS

| | | | | |
|---|---|---|---|---|
| 6,354,127 | B1 | 3/2002 | Rossini | |
| 6,843,091 | B2 | 1/2005 | Hartung et al. | |
| 2008/0098784 | A1 * | 5/2008 | Hartung et al. | 72/160 |

FOREIGN PATENT DOCUMENTS

| | | |
|---|---|---|
| CN | 101068631 | 8/2005 |
| DE | 100 53 933 | 5/2002 |

(Continued)

OTHER PUBLICATIONS

Alfred Böge "Technische Mechanik" 26 edition published 2003.

*Primary Examiner* — Debra Sullivan
(74) *Attorney, Agent, or Firm* — Cozen O'Connor

(57) ABSTRACT

A method for leveling parts in a roller leveling machine, which includes an upper and a lower roller frame, and in which upper and lower leveling rollers are each arranged in a separate leveling roller block, at least one of the leveling roller blocks being variable in its position and angle so that the leveling gap can be adjusted, wherein at least one leveling gap setting device is arranged at the infeed side and at the outfeed side of the leveling machine, and an automatic leveling gap control is provided to set the leveling gap. The method includes determining, for each leveling triangle of the roller leveling machine, an offset value based on the thickness, width, and bending moment of the part to be leveled and characteristics of the leveling machine including a max deflection of the roller frame, and readjusting a setting device of the leveling gap as a function of the leveling triangles mapped onto the part to be leveled as it moves through the leveling gap.

5 Claims, 5 Drawing Sheets

(56) References Cited

FOREIGN PATENT DOCUMENTS

| | | |
|---|---|---|
| EP | 1 048 371 | 11/2000 |
| EP | 1 402 966 | 3/2004 |
| EP | 1 294 503 | 8/2005 |
| EP | 2 177 283 | 4/2010 |

* cited by examiner

| lengt l [mm] | width b [mm] | thickness s [mm] | $bs^2$ [$mm^3$] | $bs^2M$ [$mm^3$] | $bs^2M/35000$ [1] | max X [mm] | SigmaF/400 | Offset [mm] |
|---|---|---|---|---|---|---|---|---|
| | | | | | | | | |
| 65 | 400 | 5,00 | 10000 | 10000 | 0,285 | 0,4 | 0,6 | 0,068 |
| 130 | 340 | 5,00 | 8500 | 8500 | 0,242 | 0,4 | 0,6 | 0,058 |
| 195 | 205 | 5,00 | 5125 | 5125 | 0,146 | 0,4 | 0,6 | 0,035 |
| 260 | 150 | 5,00 | 3750 | 3750 | 0,107 | 0,4 | 0,6 | 0,025 |
| 325 | 115 | 5,00 | 2875 | 2875 | 0,082 | 0,4 | 0,6 | 0,019 |
| 390 | 100 | 5,00 | 2500 | 2500 | 0,071 | 0,4 | 0,6 | 0,017 |
| 455 | 100 | 5,00 | 2500 | 2500 | 0,071 | 0,4 | 0,6 | 0,017 |
| 520 | 115 | 5,00 | 2875 | 2875 | 0,082 | 0,4 | 0,6 | 0,019 |
| 585 | 150 | 5,00 | 3750 | 3750 | 0,107 | 0,4 | 0,6 | 0,025 |
| 650 | 205 | 5,00 | 5125 | 5125 | 0,146 | 0,4 | 0,6 | 0,035 |
| 715 | 340 | 5,00 | 8500 | 8500 | 0,242 | 0,4 | 0,6 | 0,058 |
| 780 | 400 | 5,00 | 10000 | 10000 | 0,285 | 0,4 | 0,6 | 0,068 |

Fig. 7

| Experiment | Initial Curvature | Infeed Setting | Outfeed Setting | Result | Remarks |
|---|---|---|---|---|---|
| 1 | 12 mm | 4 mm | 5 mm | < 0.4 mm | with offset |
| 2 | 0.4 mm | 4 mm | 5 mm | < 0.8 mm | w/o offset |
| 3 | 0.8 mm | 4 mm | 5 mm | < 0.4 mm | with offset |

Fig. 8.

METHOD FOR LEVELING PARTS IN A ROLLER LEVELING MACHINE

BACKGROUND OF THE INVENTION

1. Field of Invention

The present invention pertains to a method for leveling parts in a roller leveling machine.

2. Discussion of Background Art

Roller leveling is a bending method in which certain tools, called leveling rollers, bend the material to be leveled back and forth. The machines used to carry out the method are called leveling machines. In these machines, the material to be leveled is passed between two opposing rows of leveling rollers, which are offset from each other. The upper and lower rows of leveling rollers are offset from each other in such a way that the rollers of one row nest in the intermediate spaces between the opposing rollers. The depth to which the rollers nest in these intermediate spaces and the geometry of the leveling rollers themselves determine the degree of the back-and-forth bending, which must occur in the partially plastic state. The greatest degree of back-and-forth bending occurs on the infeed side of the leveling machine and usually decreases in the direction toward the outfeed side of the machine, wherein as a rule no bending is applied to the leveled material at the outfeed. A distinction is made between strip leveling and part leveling.

Strip leveling is the leveling of sheet metal strips which have been wound up into coils and which must be unwound and flattened before they can be subjected to further processing in a press, for example, or in a profiling system. A strip leveling machine is therefore always an element of a processing line and must ensure the reliability of the process by maintaining the flatness of the leveled strip within the specified tolerances. What is involved here is usually an intermediate fabrication step. Part leveling, however, is usually a final fabrication step.

The thickness spectrum in the case of part leveling machines is much wider than that in the case of strip leveling machines because of the limitation on the thickness of the material which can be wound up into a coil. For an illustration of the part leveling process, see FIG. 1, which shows a schematic diagram of a part leveling machine 1. The part leveling machine 1 comprises an upper leveling roller block 3 and a lower leveling roller block 5. A set of upper leveling rollers 7, supported by backup rollers 8, is mounted in the upper leveling roller block 3. A set of lower leveling rollers 9, supported by backup rollers 10, is mounted in the lower leveling roller block 5. In the case of the part leveling machine 1 shown in FIG. 1, the lower leveling roller block 5 is permanently mounted in a machine stand (not shown), whereas the upper leveling roller block 3 is installed in an upper roller frame so that its position and angle can be adjusted. The leveling gap is adjusted by means of a leveling gap control system, by means of which, for example, deviations from the desired nominal value of the leveling gap can be corrected.

The material to be leveled in the form of a part 11 is conveyed through the part leveling machine 1 in the direction of the arrow 13. It travels from an infeed side 15 to an outfeed side 17. As can be seen in FIG. 1, the upper leveling rollers 7 are nesting in the intermediate spaces between the lower leveling rollers 9, as a result of which the part 11 is bent back and forth. The depth to which the upper leveling rollers 7 nest in the intermediate spaces between the lower leveling rollers 9 decreases continuously in the direction toward the outfeed side 17 until a space is created which is essentially equal to the thickness of the material of the part 11. The leveling gap which has been set between the roller blocks is the factor which determines the result of the leveling process.

Because the machine is designed in blocks, two defined reference points are sufficient to obtain reproducible settings, provided that the leveling rollers are parallel. It is advantageous for the settings to be made near the infeed side and near the outfeed side of the leveling machine. As can be seen in FIG. 1, the upper leveling roller block 3 can be moved vertically, as indicated by the double arrow 19, and it can also be pivoted around an axis parallel to the axes of the upper and lower leveling rollers, as indicated by the double arrow 21. All of the required settings of the leveling gap can thus be realized.

A disadvantage of leveling machines is that the leveling gap does not remain constant during the leveling process; the gap in fact changes in accordance with the elastic behavior of the mechanical components. The thicker the parts, the greater the forces and the larger the necessary dimensions of the components. Especially in cases where the parts to be leveled are thick, the elastic deflections are many times greater than the setting theoretically required for a rigid part.

Installing an automatic leveling gap control system improves the leveling process, i.e., the results of that process, by reducing the effects of the elastic behavior. Sensors, which are attached, for example, to the corners of the upper leveling roller block 3, detect movement, and a control unit actuates a hydraulic or mechanical adjusting element or an adjusting element based on hybrid technology to correct the leveling gap at these points and thus to maintain the set value. The results of the leveling process now depend essentially only on the stiffness of the leveling roller blocks, especially of the upper, movable leveling roller block.

It has been shown that, by the use of leveling gap control, it is possible to level parts in a single pass, that is, parts which in the most favorable case would require several passes through conventional leveling machines or which could not be leveled at all by them.

The leveling process is especially difficult in the case of parts which do not have a rectangular contour but have instead round contours and/or large cut-out areas. To achieve a more-or-less usable end result, it is necessary to conduct extensive practical testing to find the proper settings. This is time-consuming and therefore also expensive.

Many manufacturers today offer the possibility of using the control system to obtain suggestions for the parameter settings by manually entering the thickness of the material, for example, or by acquiring this value from a measuring system. Because the contours of the parts for part leveling can differ widely from each other, as explained above, basing the process on the thickness of the material alone is not sufficient. Readjustment is possible and usually necessary, and the new settings thus found can be stored again.

The crucial point in the leveling of material is that the yield point must be exceeded when the material is bent. The bending moment, that is, the internal load on the material, must be so large that certain parts of the cross section start to flow. The forces required for this are determined by the product $bs^2\sigma_F$ for a part with a constant rectangular cross section, where b is the width of the material to be leveled, s the thickness of the material, and $\sigma_F$ the yield point of the material.

From the field of elastostatics, the variable $(bs^2)/6$, for example, is known as the moment of resistance to bending in the case of a rectangular cross section. The basis of this calculation is beam theory, the essentials of which are shown in FIGS. 2-4. According to this theory, the normal stress σ in the beam cross section is calculated by the relationship $$\sigma=M/I$$

where M is the bending moment, I the axial area moment of inertia, and z the distance of the point under consideration from the neutral fiber. In terms of absolute value, the stress, which thus has a linear distribution, is the greatest at the farthest edge point. We therefore obtain:

$$\sigma=M/W$$

with $W=I/|z|_{max}$ as the moment of resistance. From this we can calculate the bending moment necessary to reach the yield point at the edge of the cross section. In FIG. 2, furthermore, A is the area of the cross section, S the center of gravity, dA a small differential area element, and x-y-z the coordinate system. The latter can also be seen in FIGS. 3 and 4. FIG. 3 shows the change in the bending stress and FIG. 4 the bending moment.

Under the assumption of ideal elastic-plastic material behavior, the greatest bending moment which can be transmitted in the case of a rectangular cross section is 1.5 times the previously mentioned bending moment capable of producing flow at the edge of the cross section. The flow in this case is already distributed over the entire cross section, and the load-bearing capacity of the cross section is exhausted.

The parts to be leveled usually have a cross section which varies as a function of the contour and the thickness of the part. The moment of resistance, therefore, is not constant but rather changes over the length of the part.

SUMMARY OF THE INVENTION

The present invention is therefore based on a goal of providing a method for leveling parts in a part leveling machine in which the disadvantages cited above are avoided and which leads to considerable improvement in the results achieved for the leveled parts.

According to the invention, the method comprises the following steps:

(a) acquiring the overall length (l) of the part to be leveled;

(b) dividing the length of the part to be leveled into a number n of equal partial areas with the side length ΔX, the size of which is to be selected so that an integer number of partial areas with side length ΔX lies in each leveling triangle of length 2t;

(c) acquiring the thickness s of the part to be leveled;

(d) acquiring the width b in the center of each partial area;

(e) calculating the value $bs^2$ for each partial area;

(f) determining the values $bs^2M$ by simple averaging over the number of values $bs^2$ present in each leveling triangle;

(g) dividing the values $bs^2M$ by the characteristic value of the leveling machine and multiplying the values thus obtained by the value of the maximum deflection (max X) of the roller frame comprising the adjustable leveling roller block and by the ratio of the yield point of the material to be leveled ($\sigma_F$) to the maximum design value of the leveling machine, from which the optimum value for the offset or correction is obtained; and (h) adding, during the leveling of the part to be leveled, the offset value determined for each leveling triangle to the basic setting value of the leveling gap on the infeed side of the leveling machine so as to readjust the setting device of the leveling gap as a function of the leveling triangles mapped onto the part to be leveled as it moves through the leveling gap.

As a result of the shifting of the block, i.e. because the leveling rollers are shifted all together in a block, the back-and-forth bends produced in the machine become highly dependent on each other, in contrast to the situation which exists when the leveling rollers are adjusted individually. The blockwise shift brings about, so to speak, a uniform decrease in the degree of back-and-forth bending from the infeed side to the outfeed side of the machine.

In the theory of leveling, a leveling triangle is defined as the smallest unit in a leveling machine. A leveling triangle of this type is shown in FIG. 5. The distance between two lower leveling rollers 9 has the value 2t, which is the value of the length of the leveling triangle, where the upper leveling roller 7 is located perfectly symmetrically in the middle, that is, at the same distance t from each of the two lower leveling rollers 9. FIG. 5 also shows the thickness s of the material 11 to be leveled and the nesting distance or depth Z by which the upper leveling roller 7 moves down and enters the intermediate space between the two lower leveling rollers 9 to produce the back-and-forth bending of the material 11 to be leveled. R stands for the radius of the leveling rollers 7 and 9, and $\rho_n$ is the bending radius around the neutral fiber of the material being leveled.

The leveling triangle, according to the invention, is selected as a reference value, wherein, according to feature (h), its length 2t is mapped onto the part to be leveled. Reference is therefore made in the following to the correspondingly mapped part.

Leveling is usually carried out with parallel leveling rollers, because the thickness s of the part to be leveled does not change or changes to only an insignificant degree. In special cases, the thickness s must be acquired several times as appropriate.

BRIEF DESCRIPTION OF THE DRAWINGS

Further details, features, and advantages of the invention can be derived from the following description, in which:

FIG. 7 shows a table with the acquired values and the parameters for calculating the offset according to an embodiment of the present invention; and FIG. 8 shows a table of the results of three experiments conducted to determine the result of leveling with and without an offset.

DETAILED DESCRIPTION

Figure 1:
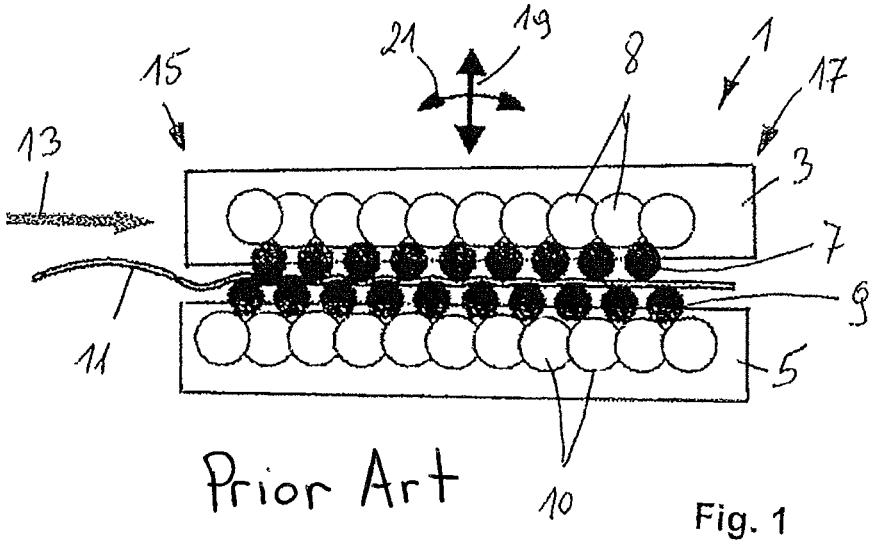
FIG. 1 is a schematic side view of a prior art part leveling machine.
Figure 2:
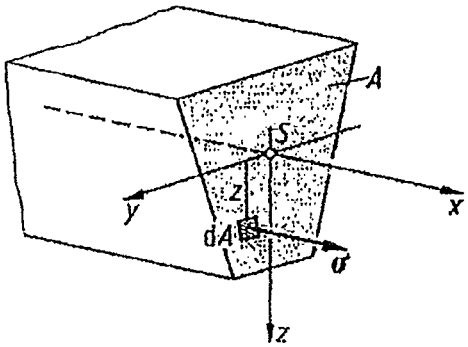
FIGS. 2-4 are perspective and side views of a strip to be leveled illustrating the various parameters of a strip to be leveled.
Figure 3:
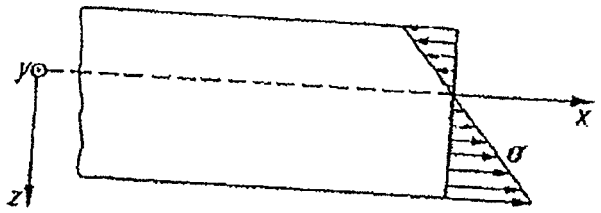
Figure 4:
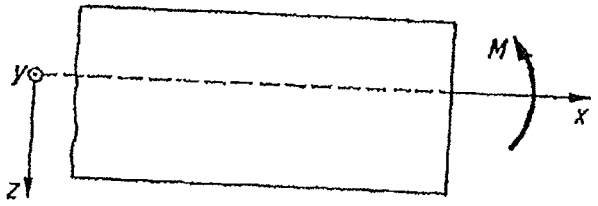
Figure 5:
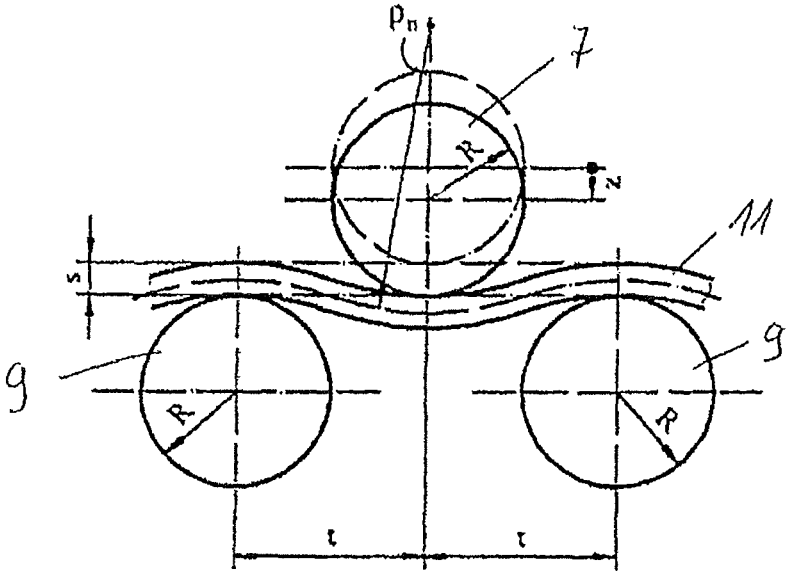
Prior Art Fig. 5
FIG. 5 is a side view of a leveling triangle in a prior art leveling machine.
Figure 6:
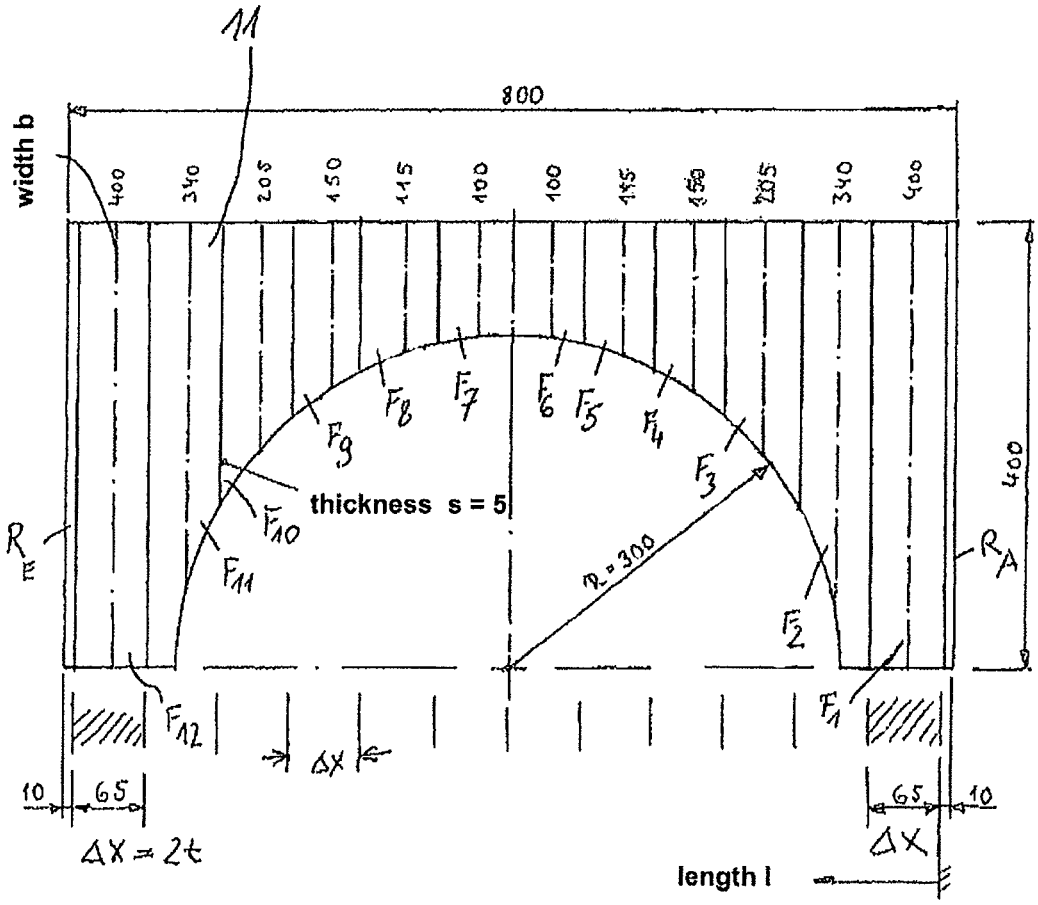
FIG. 6 shows a part to be leveled and the values to be acquired according to an embodiment of the present invention.

FIG. 6 shows a part 11 to be leveled, which has here a bridge-like contour; that is, it has a rectangular shape with a semicircular cutout with radius R in the middle. The part 11 has the thickness s. The leveling triangle in the case of the example of FIG. 6 measures 65 mm, which means that the dimension 2t equals 65 mm. In the example, therefore, the side length ΔX of the partial area component of the part 11 to be leveled is selected so that it is equal to the dimension 2t, that is, to the length of the leveling triangle.

The width of the part 11 is 400 mm at both the front and the back edge, and its total length, which is measured from right to left, opposite the direction of travel of the part 11 to be leveled through the part leveling machine, as indicated by arrow 13, is 800 mm. Width b is measured is the middle of each partial area, which is shown by the dash-dot line.

Column 1 of the table of FIG. 7 gives the positions of the leveling triangles. The numbers mean that the first leveling triangle, for example is located in the 0-65 mm position, the second leveling triangle in the 65-130 mm position etc.

As can also be seen from FIG. 7, after acquisition of the width b in the middle of each of the partial areas $F_1$ to $F_{12}$ in FIG. 6 and after acquisition of the thickness s, the value $bs^2$ can be determined. The values $bs^2M$ are then determined by simple averaging over the number of values $bs^2$ present in each leveling triangle. The reason that the values in column $bs^2M$ are identical to those in column $bs^2$ is that the side length ΔX is equal to the value 2t. The value $bs^2M$ is then put into relation to, i.e. divided by the specific leveling machine characteristic established for the leveling machine in question, in the example here, "35,000". This value is obtained from the maximum value for $bs^2$ allowable for the leveling machine and from $\sigma_F$, which is 400 N/mm$^2$ for the leveling machine under consideration here.

The maximum deflection value max X of the leveling machine or of the associated roller frame is 0.4. The next column gives the ratio of the yield point of the material to be leveled $\sigma_F$=240 to the design variable of the leveling machine $\sigma_F$=400. The ratio 240/400 results in the value 0.6. According to the invention, we now calculate the offset value for the width in question (see FIG. 7) by multiplying the three factors together, namely, the individual value for $bs^2M$/35,000, the maximum deflection max X, and the yield point ratio. As can be seen, the values are quite small (data in the table accurate to within 1/1,000); nevertheless, the addition of the offset value in question to the basic setting for the leveling gap leads to a surprisingly large improvement in the leveling results.

As explained above, these offsets are added to the basic settings of the leveling gap on the infeed side as a function of the position of the part. The effect takes place in the area of the greatest leveling force, which, in the case of a fully occupied leveling machine, is located approximately in the area of the second leveling triangle (seen from the infeed side). The outfeed side is usually kept constant, but it can be adjusted, of course, if necessary. The way in which the method works was demonstrated by way of example on a hydraulic leveling machine with automatic leveling gap control according to the following procedure:

The part 11 according to FIG. 6 was used as the test plate. The basic setting for the test plate with a thickness of 5 mm and with a yield point $\sigma_F$ of 240 N/mm$^2$ was:

infeed: 4 mm (that is, a nesting distance of 1 mm)

outfeed: 5 mm (that is, nesting distance of 0 mm).

The results of three experiments are listed in FIG. 8. The tested part had an initial curvature of 12 mm in Experiment 1, and through the use of the offset, a final curvature of <0.4 mm was obtained.

In Experiment 2, this part was leveled by the same leveling machine with the same settings at the infeed and outfeed sides as in Experiment 1, except that no offset value was used. Surprisingly, the result was worse than that in Experiment 1, namely, <0.08 mm. This part was leveled again in the same leveling machine with the same settings on the infeed and outfeed sides as the previous experiments, wherein the result of Experiment 1 was reproduced. This shows that, with the help of the inventive method, it is possible to achieve a significant improvement in the leveling result.

As can be seen in FIG. 6, a division into twelve partial areas F1 to F12 is obtained as a function of the value 2t (leveling triangle), wherein, as a result of the integer division of the overall area, a front edge area $R_A$ and a rear edge area $R_E$ of 10 mm each are present as a remainder.

According to the invention, the boundaries or lengths of the partial areas are to be selected in such a way that an integer number n>1 of equal partial areas with side lengths of ΔX lie within the leveling triangle of length 2t. As a result of the side lengths ΔX determined in this way, there is a piece left over, which is either divided between the front and rear of the part or left at one end and ignored, if the partial areas are small enough. The size of the partial areas should be adapted to the complexity of the part to be leveled. In other words, in the case of a contour with pronounced changes or with widely varying amounts of material (recesses, holes), correspondingly small side lengths ΔX will be selected so that the changes in the values $bs^2$ used to calculate the offsets can be acquired with sufficient accuracy.

In cases where the thickness is theoretically equal, the results $bs^2$ are proportional to the associated width of the partial area. When in practice values are obtained by measurement, deviations within the range of the measurement accuracy will, of course, be present.

The widths b and the thicknesses s are especially easy to state if the part to be measured is acquired by CAD. A small additional utility program will then usually be sufficient to obtain the following values, namely, the averages $bs^2M$.

There is also the advantageous possibility of acquiring the contour of the part 11 from camera images or by laser scanning in conjunction with the thickness measurement of the part 11 to be leveled. An appropriate computer program will then carry out the calculation.

The acquired or calculated curves obtained from the values $bs^2M$ are now used in association with the mathematical model to determine the settings; in particular, it is possible to derive the greatest leveling force from the maximum value obtained for the $bs^2M$ values.

It is also advantageous to expand the mathematical model not only to take into consideration the elastic behavior of the upper, movable roller frame but also to take into consideration the elastic behavior of the stationary machine stand. When the part is shorter than the length of the overall leveling machine, the number of mechanical leveling rollers can also be taken into consideration, and the change in the elastic behavior at the infeed and outfeed ends of the material being leveled can also be included.

By detecting the position of the part to be leveled, the acquired offset value can be assigned to the corresponding partial area $F_1$ to $F_{12}$, i.e., to the leveling triangle mapped onto it, and the basic setting of the leveling value can be increased by the corresponding offset, which leads to a considerable improvement in the leveling result. If desired, the force can also be measured, which makes it possible to monitor the leveling forces and to prevent the machine from becoming overloaded.

The present invention creates a method for leveling parts in a roller leveling machine which, through the adjustment of the positions of the leveling rollers, which are arranged in blocks, is more economical, simpler, and more universally applicable than the method based on the individual adjustment of each leveling roller. Because many back-and-forth bends are intentionally produced, the residual stress distribution is more favorable than in the case of machines with only a few rollers. If, however, it is possible to make only a few back-and-forth bends, as is the case, for example, with certain new high-strength materials, the leveling roller machine can be adjusted in such a way that some of the leveling rollers remain out of engagement.

The invention is not limited to the examples shown. The term "part" also includes very long parts with a special contour or with cutouts and also strips unwound from a coil such as perforated strips. In the latter case, the strip unwound from the coil and first provided with holes by suitable stamping or cutting processes; only after that is it leveled. The inventive method is especially suitable for leveling workpieces of this type which sometimes have very pronounced differences in the material over the length of the workpiece.

The invention claimed is:

1. A method for leveling parts in a roller leveling machine, which comprises an upper roller frame and a lower roller frame, and in which upper and lower leveling rollers are each arranged in a separate leveling roller block, the upper and lower leveling rollers defining leveling triangles having lengths 2t, at least one of the leveling roller blocks being variable in its position and angle so that a leveling gap can be adjusted, wherein at least one leveling gap setting device is arranged at an infeed side and/or at an outfeed side of the leveling machine, wherein an automatic leveling gap control is provided to set the leveling gap, the method comprising:

(a) acquiring an overall length of a part to be leveled;

(b) dividing the length of the part to be leveled into a number n of equal partial areas with a side length $\Delta X$, the size of which is selected so that an integer number of partial areas with side length $\Delta X$ lies in each of the leveling triangles of length 2t;

(c) acquiring a thickness s of the part to be leveled;

(d) acquiring a variable width b in the center of each of the partial areas;

(e) calculating the value $bs^2$ for each partial area;

(f) determining the average values $bs^2_M$ by simple averaging over the number of values $bs^2$ present in each of the leveling triangles;

(g) dividing the average values $bs^2_M$ by a characteristic value of the leveling machine and multiplying the quotients thus obtained by the value of a maximum deflection (max X) of the roller frame comprising the adjustable leveling roller block and by a ratio of a yield point of a material to be leveled ($\sigma_F$) to a maximum design value of the leveling machine, from which an optimum value for an offset or correction is obtained, wherein the characteristic value is a function of a maximum value of $bs^2$ of the roller leveling machine and $\sigma_F$; and (h) adding, during the leveling of the part to be leveled, the offset value determined for each of the leveling triangles to a basic setting value of a leveling gap on the infeed side of the leveling machine so as to readjust the setting device of the leveling gap as a function of the leveling triangles mapped onto the part to be leveled as it moves through the leveling gap.

2. The method according to claim 1, wherein the leveling gap is further determined as a function of an elastic behavior of the roller frame which comprises a movable leveling roller block and the elastic behavior of the roller frame or machine stand with a stationary leveling roller block.

3. The method according to claim 1, wherein in the case that the part to be leveled is shorter than the leveling roller blocks, a reduced number of leveling rollers participate in the leveling of such a part.

4. The method according to claim 1, wherein the leveling gap is further determined as a function of a change in an elastic behavior upon at least one of the infeed side and the outfeed side of the material to be leveled is used.

5. The method according to claim 1 wherein a shape of the part to be leveled is acquired by means of an optical camera scanning device or a laser scanning device.

* * * * *